United States Patent [19]

Zingale

[11] Patent Number: 5,072,867

[45] Date of Patent: Dec. 17, 1991

[54] GOLF BAG CARRIER AND METHOD THEREFOR

[76] Inventor: Ron P. Zingale, 8071 E. Del Tornasol, Scottsdale, Ariz. 85258

[21] Appl. No.: 523,660

[22] Filed: May 15, 1990

[51] Int. Cl.[5] ..... B65H 75/40

[52] U.S. Cl. ..... 224/162; 224/202; 206/315.3

[58] Field of Search ..... 224/162, 202, 257, 258; 206/315.3, 315.6, 315.5; 242/107, 107.4; 150/108

[56] References Cited

U.S. PATENT DOCUMENTS

| | | | |
|---|---|---|---|
| 1,636,194 | 7/1927 | Mullins | 206/315.6 |
| 2,614,355 | 10/1952 | Rogers et al. | 224/150 |
| 3,198,300 | 8/1965 | Tuttle | 224/162 |

FOREIGN PATENT DOCUMENTS

| | | | |
|---|---|---|---|
| 1028376 | 5/1953 | France | 224/162 |
| 401381 | 4/1966 | Switzerland | 224/162 |

*Primary Examiner*—Linda J. Sholl

*Attorney, Agent, or Firm*—Harry M. Weiss

[57] ABSTRACT

A golf bag carrier having an automatically adjustable strap subassembly for fitting the shoulder of a golfer. The carrier has a bag subassembly having a peripheral wall and a bottom wall and an open top wall portion. The carrier also has a strap subassembly passing through a slotted hole in the peripheral wall forming a top exterior strap end and a bottom interior strap end. The carrier also has a retractor unit having a housing mounted on the bottom wall within the peripheral wall and having a spring-biased latchable cylinder rotatable relative to the housing and fixedly connected to the bottom interior strap end.

8 Claims, 1 Drawing Sheet

GOLF BAG CARRIER AND METHOD THEREFOR

BACKGROUND OF THE INVENTION

1. Field of Invention

This invention relates to a golf bag carrier and method therefor, and, in particular, the invention relates to a golf bag carrier and method therefor having a retractable strap subassembly.

2. Description of the Prior Art

One prior art golf bag carrier is described in U.S. Pat. No. 2,533,440, issued Dec. 12, 1950. This carrier includes a bag subassembly and a fixed strap subassembly.

One problem with this prior art bag carrier is that the strap subassembly projects outwardly from the bag subassembly which is unsuitable sometimes for placement in an automobile trunk. Another problem is that a fixed strap subassembly usually extends from the upper portion of the golf bag down to the lower portion of the golf bag thereby making it not only difficult to obtain access to exterior pockets or containers for golf balls, that are located behind the strap, but also crushes or collapses these pockets or containers because of the inward pressure of the strap on the exterior surface portion of the pocket or containers.

Related prior art patents include U.S. Pat. Nos.:

1,936,021; issued Nov. 21, 1933
3,198,300; issued Aug. 3, 1963
3,357,613; issued Dec. 12, 1967
4,600,100; issued July 15, 1986, and
4,676,464; issued June 30, 1987.

SUMMARY OF THE INVENTION

According to the present invention, a golf bag carrier or assembly is provided. For example, a golf ball container is provided having a peripheral wall portion containing an opening therein, a bottom wall portion, and an open top wall portion. Retractable strap means are provided which are connected at one end to said peripheral wall portion and at the other end inside said golf bag container thereby providing a strap that can be pulled out for use by a golfer carrying the golf bag container and that can retract the strap substantially close, to said peripheral wall portion when the strap is not being used.

This golf bag carrier or assembly further comprises a bag subassembly having a wall with a slotted hole, and the retractable strap means comprises a retractable strap subassembly having an elongate strap passing through the slotted hole and separating a top exterior strap end fixedly connected to the wall at a top end portion thereof from a bottom interior strap end and having a retractable unit fixedly connected inside said bag subassembly at a bottom end portion thereof and also fixedly connected to the bottom strap end for automatically adjusting the length and position of the strap.

By using the retractable unit and the strap arrangement, the problem of the outwardly projecting strap is avoided, and the problem of crushing or collapsing the exterior pockets or containers is also avoided.

The foregoing and other objects, features and advantages will be apparent from the following description as the preferred embodiment of the invention as illustrated in the accompanying drawings.

DESCRIPTION OF THE PREFERRED EMBODIMENT

Figure 1:
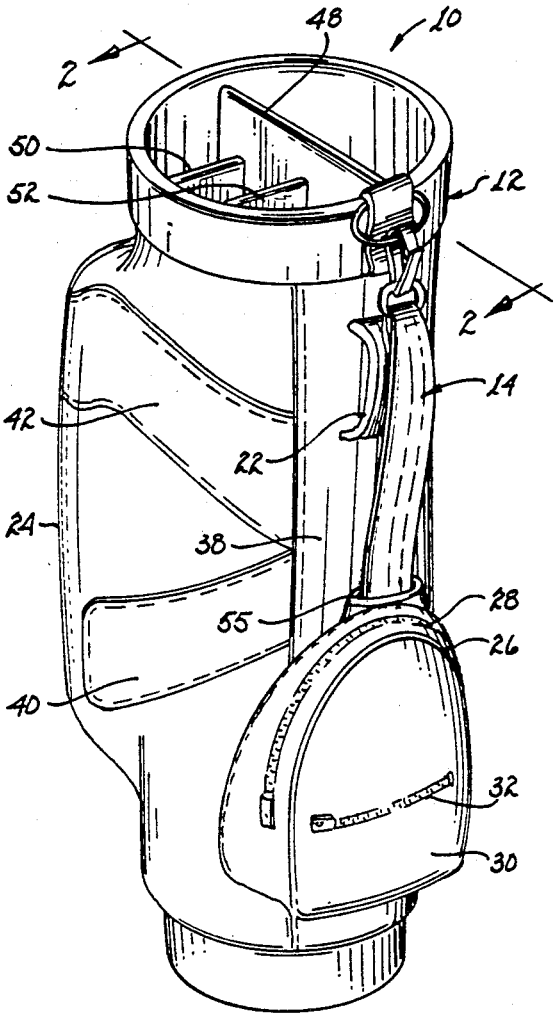
FIG. 1 is a perspective view of a golf bag carrier according to the present invention.

As shown in FIGS. 1 through 4, a golf bag carrier 10 is provided. Carrier or assembly 10 includes a bag subassembly 12, and a carrier or retractable strap subassembly 14 (see FIG. 1).

Figure 2:
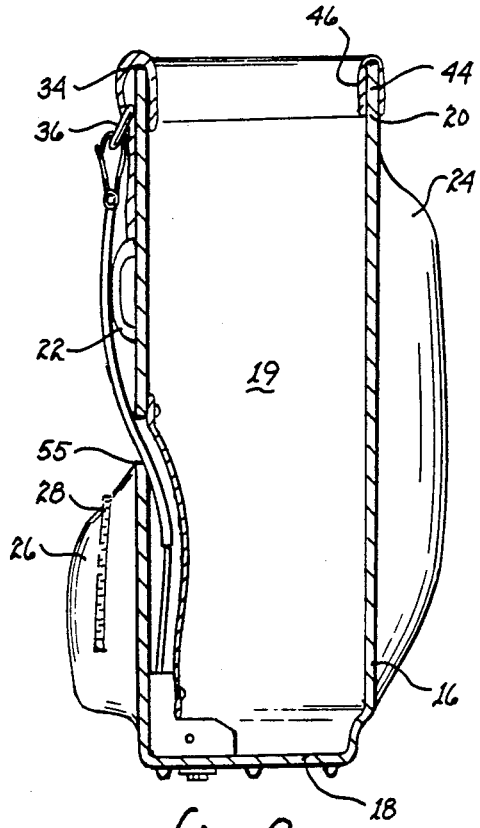
FIG. 2 is a section view as taken along line 2—2 of FIG. 1 showing the strap in its retracted position.
Figure 4:
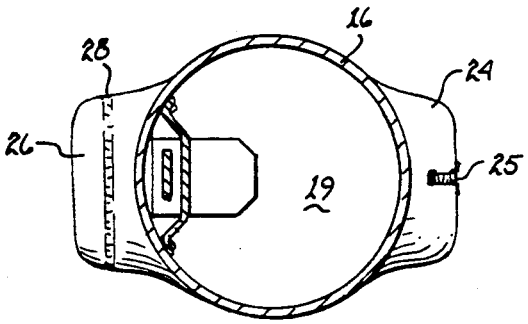
FIG. 4 is a plan section view as taken along line 4—4 of FIG. 3.
Figure 3:
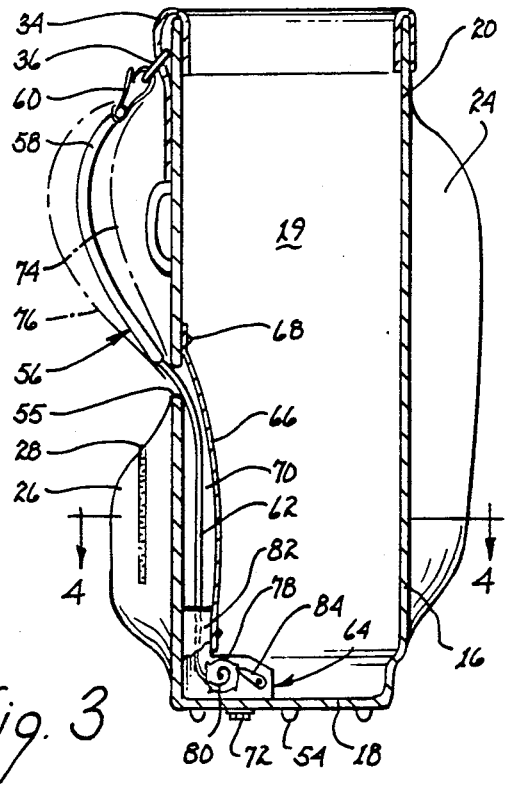
FIG. 3 is a section view corresponding to FIG. 2 showing the strap in its extended position.

Bag subassembly 12 has a peripheral wall 16 (see FIGS. 2, 3 and 4) and a bottom wall 18 (see FIGS. 2 and 3), which enclose a cavity 19 (see FIGS. 2, 3 and 4), and a top wall portion 20 (see FIGS. 2 and 3). Peripheral wall 16 has a handle 22 (see FIGS. 1 and 2), which is fixedly connected thereto at its ends. Wall 16 has an elongate pocket 24 (see FIGS. 1, 2, 3 and 4) which has a zipper 25 (see FIG. 4) and which is used for storing items, and has a pocket 26(see FIGS. 1, 2 and 3) which has a zipper 28 (see FIG. 1) and which is used for holding golf balls and the like, and has a pocket 30 which has a zipper 32 and which is used for holding tees and the like. Wall 16 also has a fixed loop 34 (see FIGS. 2 and 3) which is fixedly connected thereto at its ends. Loop 34 has a ring 36 which passes therethrough. Wall 16 also has a first reinforced portion 38 (see FIG. 1) which is disposed adjacent to strap subassembly 14, and has a second reinforced portion 40 and a third reinforced portion 42 which are disposed adjacent to elongate pocket 24.

Top wall portion 20 has an annular reinforced wall portion 44 (see FIG. 2) which surrounds a top opening 46, and ha a transverse separator bar 48 (see FIG. 1) and two small separator bars 50, 52 for separating selected golf clubs. Bottom wall 18 has a plurality of exterior support projections 54 (see FIG. 3). Peripheral wall 16 has a slotted hole or opening 55, which is disposed just above pocket 26.

Retractable strap subassembly 14 has an elongated strap 56 (see FIG. 3), which passes through slotted hole 55. Strap 56 has a top strap end 58 which preferably has a snap-on clip 60, and strap 56 has a bottom strap end 62 which connects to a roll-up retractor unit 64.

Subassembly 14 also has a partition or cover 66 which is fixedly connected to peripheral wall 16 by a plurality of connectors or rivets 68. Partition 66 forms or encloses a space 70, which is separate from cavity 19. Bottom strap end 62 and at least a portion of retractor 64 are disposed in space 70. Retractor 64 is fixedly connected to bottom wall 18 by a connector or bolt 72. Top strap end 58 has a retracted or tightened position 74 and an extended or loosened position 76, which are typical positions that are set by pulling top strap end 58 until bottom strap end 62 is finally locked or held in place by retractor 64.

As shown in FIG. 3, in a schematic view, retractor 64 preferably has a sprocket or cylinder 78, which is fixedly connected to bottom strap end 62, and has a roll-type spring 80, which is fixedly connected to cylinder 78. Retractor 64 also has a housing 82, which encloses cylinder 78 and spring 80, and has a latch 84, which locks cylinder 78 to stop its rotation o which unlocks cylinder 78 for its rotation.

The additional advantages of assembly 10 are indicated hereafter.

(a) Top strap 58 can be tightened to position 74 so that it does not project outwardly from peripheral wall 16 for ease of storage in a car truck or the like.

(B) Top strap 58 can be adjusted and locked in place easily, without the difficulty of buckling the end of the strap, and the like.

(C) The opening 55 is located above the pocket 26 thereby avoiding having the lower portion 66 of the strap 56 to collapse or crush the pocket 26.

While the invention has been described in its preferred embodiment, it is to be understood that the words which have been used are words of description rather than limitation and the changes may be made within the purview of the appended claims without departing from the true scope and spirit of the invention in its broader aspects.

I claim:

1. A golf bag carrier comprising:

a bag subassembly having a peripheral wall and a bottom wall and an open top wall portion enclosing a cavity;

the peripheral wall having a slotted hole;

a strap subassembly having an elongate strap which passes through the slotted hole separating a top exterior strap end from a bottom interior strap end and having a roll-up retractor unit mounted in the cavity adjacent to the bottom wall;

the top exterior strap's end being fixedly connected to the top wall portion and the bottom interior strap being fixedly connected to the retractor unit.

2. The carrier of claim 1, wherein the retractor unit has an exterior portion fixedly connected to the bottom wall, and has an interior portion which is rotatable relative to the exterior portion and which is fixedly connected to the bottom interior strap end and which is a latchable and a spring-biased interior portion.

3. The carrier of claim 1, wherein the peripheral wall has a partition which encloses a space separate from the cavity and which covers the slotted hole that opens into the space and which covers the bottom interior strap end and at least a portion of the retractor unit.

4. The carrier of claim 1, wherein, the top exterior strap end is adjustable in length from a typical tightened position to a typical loosened position, and the retractor unit has adjusting means for setting and locking the bottom strap end at a desired location along the bottom strap end.

5. The carrier of claim 1, wherein the peripheral wall has a handle which is fixedly connected thereto at its ends and which is disposed adjacent to the top exterior strap end, and has a plurality of storage pockets, and the open top wall portion has a fixed loop which is fixedly connected thereto and which has a ring passing therethrough, and the top exterior strap end has a snap-on clip which is fixedly connected thereto for connection to the ring.

6. The carrier of claim 1, wherein the peripheral wall has a plurality of reinforced wall portions, the open wall portion has a plurality of separator bars and has an opening divided into opening portions by the separator bars; and the bottom wall has a plurality of exterior support projections.

7. A method of adjusting a golf bag carrier, including the steps of:

forming a golf bag subassembly having a peripheral wall with a slotted hole and having a bottom wall and having an open top wall portion all of which enclose a cavity;

forming a strap subassembly having an elongate strap extending through the slotted hole forming a top exterior strap end and a bottom interior strap and;

mounting a retractor unit inside the cavity fixedly connected to the bottom wall;

attaching the bottom strap interior end to the retractor unit; and tensioning by hand the top exterior strap end until the bottom interior strap end is locked in place at a desired location giving a desired position of tightness to the top exterior strap end.

8. A golf bag carrier comprising, in combination:

a golf bag container having a peripheral wall portion containing an opening therein, a bottom wall portion and an open top wall portion; and retractable strap means connected at one end to said peripheral wall portion and at the other end inside said golf bag container for providing a strap that can be pulled out for use by a golfer carrying said golf bag container and that can retract the strap substantially close to said peripheral wall portion when the strap is not being used.

* * * * *